US010102761B2

(12) United States Patent
Takabayashi et al.

(10) Patent No.: US 10,102,761 B2
(45) Date of Patent: Oct. 16, 2018

(54) ROUTE PREDICTION DEVICE

(71) Applicant: Mitsubishi Electric Corporation, Tokyo (JP)

(72) Inventors: Yuki Takabayashi, Tokyo (JP); Hiroshi Kameda, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 8 days.

(21) Appl. No.: 15/129,138

(22) PCT Filed: Apr. 10, 2014

(86) PCT No.: PCT/JP2014/060427
§ 371 (c)(1),
(2) Date: Sep. 26, 2016

(87) PCT Pub. No.: WO2015/155874
PCT Pub. Date: Oct. 15, 2015

(65) Prior Publication Data

US 2017/0039865 A1 Feb. 9, 2017

(51) Int. Cl.
*G08G 9/02* (2006.01)
*G08G 1/16* (2006.01)
(Continued)

(52) U.S. Cl.
CPC ..... *G08G 9/02* (2013.01); *G08G 1/166* (2013.01); *G08G 1/167* (2013.01); *G08G 3/02* (2013.01); *G08G 5/045* (2013.01)

(58) Field of Classification Search
CPC ..... G08G 9/02; G08G 1/166; G08G 1/167; G08G 3/02; G08G 5/045
See application file for complete search history.

(56) References Cited

U.S. PATENT DOCUMENTS

2009/0024357 A1 1/2009 Aso et al.
2011/0052043 A1* 3/2011 Hyung ..... G06T 7/277 382/154
2014/0303883 A1 10/2014 Aso et al.

FOREIGN PATENT DOCUMENTS

JP 11-120500 A 4/1999
JP 2985952 B2 12/1999
(Continued)

OTHER PUBLICATIONS

International Search Report issued in PCT/JP2014/060427; dated Jul. 1, 2014.
(Continued)

*Primary Examiner* — Michael D Lang
(74) *Attorney, Agent, or Firm* — Studebaker & Brackett PC

(57) ABSTRACT

A route prediction unit estimates a route of an object of interest with respect to a target object based on collision avoidance models. A collision risk estimation unit calculates collision risks between the object of interest and target object for each collision avoidance model. A collision deciding unit decides the presence or absence of a collision from the collision risks and feeds back a collision avoidance model correction value to the route prediction unit when it is determined that the collision occurs. A collision avoidance route selector selects any of the plurality of collision avoidance models in which the absence of collision is decided by the collision deciding unit, and selects a route of the collision avoidance model as a route for avoiding the collision between the objects. The route prediction unit performs a new route prediction using the collision avoidance model correction value.

10 Claims, 4 Drawing Sheets

(51) Int. Cl.
*G08G 3/02* (2006.01)
*G08G 5/04* (2006.01)

(56) References Cited

FOREIGN PATENT DOCUMENTS

| | | | |
|---|---|---|---|
| JP | 2007-233646 | A | 9/2007 |
| JP | 2007-276508 | A | 10/2007 |
| JP | 2008-265468 | A | 11/2008 |
| JP | 2009-251729 | A | 10/2009 |
| JP | 4396653 | B2 | 1/2010 |
| JP | 2012-148747 | A | 8/2012 |
| JP | 5250290 | B2 | 7/2013 |

OTHER PUBLICATIONS

An Office Action mailed by the State Intellectual Property Office of the People's Republic of China dated Apr. 26, 2018, which corresponds to Chinese Patent Application No. 201480077864.1 and is related to U.S. Appl. No. 15/129,138.

* cited by examiner

ROUTE PREDICTION DEVICE

TECHNICAL FIELD

The present invention relates to a route prediction device which uses an observational instrument comprised of sensors such as a radar and GPS, observes the position of a moving object of interest such as an aircraft, vessel and vehicle, and predicts a route for preventing the object of interest from colliding with a plurality of surrounding objects near the object of interest.

BACKGROUND ART

Recently, a technique for predicting a safe route to avoid a collision between moving bodies has been required in various fields such as a driving support system of a vehicle and air-traffic control.

For example, as for a driving support system of a vehicle, a technique has been developed which prevents a collision by acquiring the position of an obstacle such as a vehicle and stationary object existed in the periphery of a self vehicle with sensors like a millimeter wave radar or laser radar mounted on the self vehicle, by deciding a collision risk based on the relative distance and relative speed between the self vehicle and the obstacle, and then by controlling the self vehicle. In addition, as a higher technique, an automatic driving technique is being developed which recognizes a surrounding environment with sensors, carries out operations such as steering and braking automatically without the operation of a driver, and reaches a destination.

As a conventional technique relating to such a route prediction, a device disclosed in a Patent Document 1, for example, generates a plurality of prediction tracks of a vehicle in advance, and calculates existence probabilities of prediction routes in the time and space from the prediction tracks generated. In addition, a driving support device disclosed in a Patent Document 2, for example, calculates a risk potential map of a self vehicle with respect to other vehicles, and enables the control of the accelerator, brakes and the like based on the risk.

On the other hand, as for the air-traffic control, it has been considered to adopt a four-dimensional trajectory (4DT) including three-dimensional position and time into navigation in place of conventional navigation based on the three-dimensional position. The 4DT corresponds to a prediction route, and improvement in flight safety is expected because the management of the 4DT makes it possible to estimate an air traffic amount and airspace capacity. As a technique of such a route prediction, for example, a Patent Document 3 calculates future positions from the present speed and heading of a target on the assumption of linear uniform velocity.

In addition, a system disclosed in a Patent Document 4, for example, employs an optimum route search method based on an A* algorithm as a prediction method of the future positions. The algorithm determines nodes from a start to a goal (or via point) in a moving space in which a route candidate is divided into a mesh including a no entry area (obstacle).

PRIOR ART DOCUMENT

Patent Document

Patent Document 1: Japanese Patent Laid-Open No. 2007-233646.
Patent Document 2: Japanese Patent Laid-Open No. 2012-148747.

Patent Document 3: Japanese Patent Laid-Open No. H11-120500
Patent Document 4: Japanese Patent Laid-Open No. 2009-251729.

DISCLOSURE OF THE INVENTION

Problems to be Solved by the Invention

However, a conventional device as described in the Patent Document 1 must generate a lot of prediction tracks to calculate the existence probabilities, which leads to a problem in that computation load increases. In addition, a device as described in the Patent Document 2 is not clear as to a risk calculation method, and relates to a calculation method depending on parameters, which leads to a problem in that the risk cannot be accurately evaluated. Furthermore, a conventional technique as described in the Patent Document 3 has a problem of deteriorating the estimated accuracy of the future positions when a target changes a route to avoid an obstacle such as thunderclouds. In addition, a system using the A* algorithm as described in the Patent Document 4 has a problem of not considering the motion of a moving body because a route is determined by lattice points. To obtain a natural route, it is necessary to shorten the distance between the lattice points, offering a problem of sacrificing the processing time.

The present invention is implemented to solve the foregoing problems. Therefore it is an object of the present invention to provide a route prediction device capable of reducing the computing load at the time of calculating a prediction route with a low collision risk.

Means for Solving the Problems

A route prediction device in accordance with the present invention includes: a tracking processor to carry out tracking processing based on a position of an object of interest and a position of a surrounding object near the object of interest, and to calculate an estimated position and an estimated speed of the object of interest and of the surrounding object; a collision object detector to detect as a target object a surrounding object having a possibility of colliding with the object of interest based on the estimated position and the estimated speed; a route prediction unit to estimate a route of the object of interest with respect to the target object in accordance with collision avoidance models; a collision risk estimator to calculate collision risks between the object of interest and the target object in conformity with the collision avoidance models; a collision deciding unit to decide presence or absence of a collision based on the collision risks, and when it is determined that the collision occurs, to feed back a collision avoidance model correction value to the route prediction unit; and an avoidance route selector to select any of the plurality of collision avoidance models in which the absence of collision is decided by the collision deciding unit, and to select a route of the collision avoidance model as a route for avoiding a collision between the objects, wherein the route prediction unit carries out a new route prediction using the collision avoidance model correction value, and the tracking processor calculates an estimation error of the estimated position, and the collision risk estimator obtains the collision risk on a basis of a value obtained by normalizing the estimated position with the estimation error.

Advantages of the Present Invention

The route prediction device in accordance with the present invention estimates the route of the object of interest with respect to the target object in accordance with the collision avoidance models, calculates the collision risks between the object of interest and the target object in correspondence with the collision avoidance models, decides the presence or absence of a collision from the collision risks, and selects the route of one of the collision avoidance models selected from the plurality of collision avoidance models determined as expected not to cause any collision as the route for avoiding the collision between the objects. Thus, it can reduce the computing load at the time of computing the prediction route with a low collision risk.

BEST MODE FOR CARRYING OUT THE INVENTION

The best mode for carrying out the invention will now be described with reference to the accompanying drawings to explain the present invention in more detail.

Embodiment 1

Figure 1:
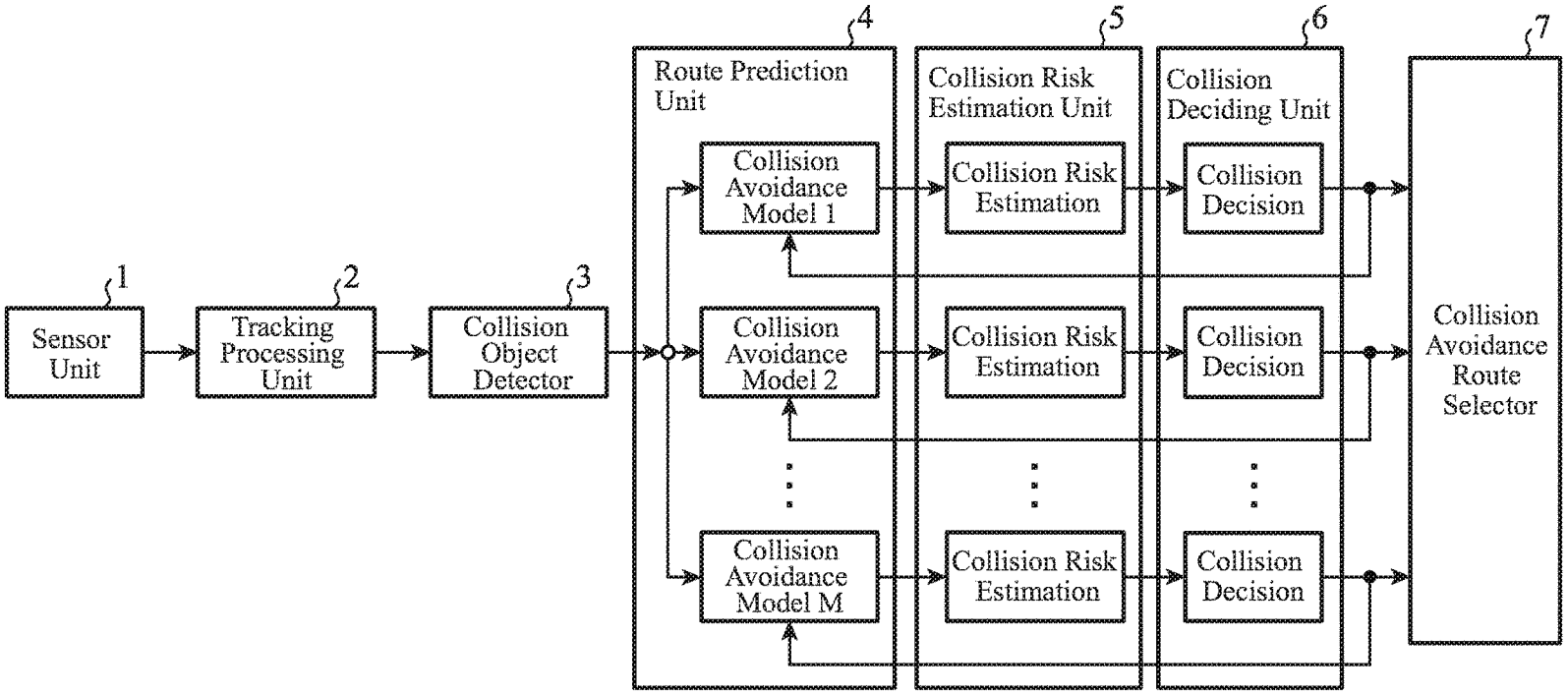
FIG. 1 is a block diagram showing a route prediction device of an embodiment 1 in accordance with the present invention.

FIG. 1 is a block diagram showing a route prediction device of the present embodiment.

As shown in FIG. 1, the route prediction device of the present embodiment comprises a sensor unit 1, a tracking processing unit 2, a collision object detector 3, a route prediction unit 4, a collision risk estimation unit 5, a collision deciding unit 6 and a collision avoidance route selector 7.

The sensor unit 1, which is a processing unit for observing relative position between an object of interest and a surrounding object near the object of interest, comprises a sensor such as a millimeter wave radar, a laser radar, an optical camera, or an infrared camera; and a communication unit for receiving a GPS position of a surrounding vehicle and that of a pedestrian. The tracking processing unit 2 is a processing unit that executes tracking processing based on a relative position observed by the sensor unit 1, and calculates the estimated positions of the object of interest and the surrounding object, their estimated speeds, estimation errors of the estimated positions, and estimation errors of the estimated speeds. The collision object detector 3 is a processing unit that detects as a target object a surrounding object having a possibility of a collision with the object of interest from the estimated positions and estimated speeds. The route prediction unit 4 is a processing unit that calculates prediction positions up to N steps ahead of the object of interest with respect to the target object in each of the M collision avoidance models (here, M and N are arbitrary integers). The collision risk estimation unit 5 is a processing unit that calculates a collision risk for each collision avoidance model from the estimated positions and estimation errors calculated by the tracking processing unit 2. The collision deciding unit 6 is a processing unit that decides the presence or absence of a collision from the collision risks calculated by the collision risk estimation unit 5, feeds back, when deciding that a collision occurs, a collision avoidance model correction value to the route prediction unit 4, and supplies, when deciding that a collision does not occur, the collision avoidance model to the collision avoidance route selector 7. The collision avoidance route selector 7 is a processing that selects one collision avoidance model from the collision avoidance models output from the collision deciding unit 6 in accordance with a prescribed decision reference, and decides a prediction route for the collision avoidance.

Incidentally, the route prediction device is constructed by using a computer, and the tracking processing unit 2 to collision avoidance route selector 7 are implemented by executing software corresponding to the functions of the individual processing units by the CPU. Alternatively, at least one of the foregoing sensor unit 1 to collision avoidance route selector 7 can be constructed by using dedicated hardware.

Next, the operation of the route prediction device of the embodiment 1 will be described.

The sensor unit 1 measures the positions and speeds of surrounding vehicles and pedestrians. According to the positions and speeds, the tracking processing unit 2 calculates, through the tracking processing, position estimated values, speed estimated values, and an estimation error covariance matrix of the positions and speeds.

The collision object detector 3 detects a surrounding vehicle with a possibility of causing a collision with the self vehicle. For example, the detection can be made in accordance with the idea of TTC (Time To Collision). The TTC is defined by Expression (1), and if the TTC is not greater than a threshold, the vehicle is detected as one having a possibility of causing a collision. Furthermore, the detected surrounding vehicle i is defined as a target vehicle.

$$TTC = \frac{\left(\hat{y}_{s,k}^{(i)} - y_k^{(ego)}\right)}{\left(\hat{\dot{y}}_{s,k}^{(i)} - \dot{y}_k^{(ego)}\right)} \tag{1}$$

$\hat{y}_{s,k}^{(i)}$: estimated position in the lengthwise direction of a surrounding vehicle i at sampling time k.

$\hat{\dot{y}}_{s,k}^{(i)}$: estimated speed in the lengthwise direction of the surrounding vehicle i at sampling time k.

$y_k^{(ego)}$: position in the lengthwise direction of the self vehicle at sampling time k.

$\dot{y}_k^{(ego)}$: speed in the lengthwise direction of the self vehicle at sampling time k.

Alternatively, as a different method of the collision object detector 3, it is also possible to set a designated region in the surroundings of the self vehicle, to detect a vehicle whose prediction positions 1-N steps ahead are expected to enter the designated region, and to consider the vehicle as a target vehicle. Here, N prediction positions up to N steps ahead are calculated by Expression (2).

$$\hat{x}_{p,k+N}^{(i)} = \Phi_N \hat{x}_{s,k}^{(i)} \tag{2}$$

$$\hat{x}_{s,k}^{(i)} = \left[\hat{x}_{s,k}^{(i)}\ \hat{y}_{s,k}^{(i)}\ \hat{\dot{x}}_{s,k}^{(i)}\ \hat{\dot{y}}_{s,k}^{(i)}\right] \tag{3}$$

$$\hat{x}_{p,k+N}^{(i)} = \left[\hat{x}_{p,k+N}^{(i)}\ \hat{y}_{p,k+N}^{(i)}\ \hat{\dot{x}}_{p,k+N}^{(i)}\ \hat{\dot{y}}_{p,k+N}^{(i)}\right]^T \tag{4}$$

$$\Phi_N = \begin{bmatrix} I_{2\times2} & N\cdot\Delta T\cdot I_{2\times2} \\ 0\cdot I_{2\times2} & I_{2\times2} \end{bmatrix} \tag{5}$$

$\hat{x}_{s,k}^{(i)}$: estimated state vector of the surrounding vehicle i at sampling time k.

$\hat{x}_{p,k+N}^{(i)}$: prediction state vector at N steps ahead of the surrounding vehicle i at sampling time k.

$\hat{x}_{s,k}^{(i)}$: estimated position in the lateral direction of the surrounding vehicle i at sampling time k.

$\hat{\dot{x}}_{s,k}^{(i)}$: estimated speed in lateral direction of the surrounding vehicle i at sampling time k.

$\hat{x}_{p,k+N}^{(i)}$: prediction position at N steps ahead in the lateral direction of the surrounding vehicle i at sampling time k.

$\hat{\dot{x}}_{p,k+N}^{(i)}$: prediction speed at N steps ahead in the lateral direction of the surrounding vehicle i at sampling time k.

$\hat{y}_{p,k+N}^{(i)}$: prediction position at N steps ahead in the lengthwise direction of the surrounding vehicle i at sampling time k.

$\hat{\dot{y}}_{p,k+N}^{(i)}$: prediction speed at N steps ahead in the lengthwise direction of the surrounding vehicle i at sampling time k.

$\Delta T$: step width.

$I_{L\times L}$: L-by-L unit matrix.

As for the target vehicle tgti detected by the collision object detector 3, the route prediction unit 4 calculates prediction positions up to N steps ahead for each of the M collision avoidance models.

Here, as the collision avoidance models, for example, it is possible to define a braking avoidance model, a left steering avoidance model, and a right steering avoidance model. The braking avoidance model is a model that avoids a collision by braking while keeping the lane, and the left/right steering avoidance model is a model that avoids a collision by changing lanes to the left/right by inputting a steering amount. In addition, it is assumed as to the models that the braking amount or steering amount is set in such a manner as not to exceed a prescribed limited value. In particular, if the collision deciding unit 6 which will be described later decides that the collision avoidance is impossible, although a correction value of the braking amount or steering amount is fed back to the route prediction unit 4, an operation is executed which will prevent the braking amount or steering amount from exceeding the prescribed limited value.

In addition, the route prediction unit 4 must set an initial value of the braking amount or steering amount of the collision avoidance model. As the initial value, it can set a value input at the time of the braking or steering avoidance. Alternatively, it can set the braking amount or steering amount that will not make a driver uncomfortable by using a learning algorithm.

Furthermore, without limited to the foregoing models, the route prediction unit 4 can be provided with a collision avoidance model corresponding to various scenes. In addition, when the number of lanes and a lane where the self vehicle travels are known from the map data and GPS position, the number of the collision avoidance models can be reduced by discarding an unnecessary collision avoidance model. For example, when the number of lanes is two, and the self vehicle travels in the left lane, the left steering avoidance is impossible, and therefore the route prediction unit 4 discards the left steering avoidance model and calculates the remaining collision avoidance models. Besides, at a point where the number of lanes increases from two to three, for example, it can add a collision avoidance model for changing the lane to the additional lane. In this way, it can easily add or remove a collision avoidance model according to the map data. Using a laser radar or camera instead of the map data enables it to recognize an external environment, and they can be used in place of the map.

A prediction position calculation method based on the collision avoidance models will be described. According to the braking acceleration $a_b$ of the braking avoidance model, the route prediction unit 4 calculates a prediction route (prediction positions up to N steps ahead) by Expression (6).

$$\hat{x}_{p,k+N}^{(ego)} = F(a_b) = \Phi_N x_k^{(ego)} + \begin{bmatrix} 0 \\ -\frac{1}{2}(N\cdot\Delta T)^2\cdot a_b \\ 0 \\ -N\cdot\Delta T\cdot a_b \end{bmatrix} \tag{6}$$

$$x_k^{(ego)} = \left[x_k^{(ego)}\ y_k^{(ego)}\ \dot{x}_k^{(ego)}\ \dot{y}_k^{(ego)}\right] \tag{7}$$

$$\hat{x}_{p,k+N}^{(ego)} = \left[\hat{x}_{p,k+N}^{(ego)}\ \hat{y}_{p,k+N}^{(ego)}\ \hat{\dot{x}}_{p,k+N}^{(ego)}\ \hat{\dot{y}}_{p,k+N}^{(ego)}\right] \tag{8}$$

$a_b$: acceleration for braking.

It can calculate the prediction route as to the left/right steering avoidance model in the same manner. Here, since the prediction position of the vehicle with respect to the steering differs depending on vehicle parameters such as the vehicle weight, the center of gravity of the body, and the yaw moment of inertia, the route prediction unit 4 sets the vehicle parameters in advance when they are known and calculates the prediction position. In addition, when the vehicle parameters are unknown, it can use parameters estimated by a learning algorithm known to the public.

The collision risk estimation unit 5 calculates a collision risk from an estimation error covariance matrix of the positions output from the tracking processing unit 2, and from the position and the speed estimated value.

As shown in Expression (9), the collision risk estimation unit 5 calculates the difference between the prediction position at n steps ahead of the self vehicle at a sampling time k and the prediction position at n (n=1, . . . , N) steps ahead of the target vehicle tgti, and calculates the value obtained by normalizing the difference by the estimation error covariance matrix, that is, calculates the square value $\varepsilon_{k+n}$ of the Mahalanobis distance.

$$\varepsilon_{k+n} = \Delta\hat{x}_{k+n}^T P_{p,k+n}^{(tgti)-1} \Delta\hat{x}_{k+n} \tag{9}$$

$$\Delta\hat{x}_{k+n} = \left[\hat{x}_{p,k+n}^{(tgti)} - \hat{x}_{p,k+n}^{(ego)}\ \hat{y}_{p,k+n}^{(tgti)} - \hat{y}_{p,k+n}^{(ego)}\right]^T \tag{10}$$

$$P_{p,k+n}^{(tgti)} = \Phi_n P_{s,k}^{(tgti)} \Phi_n^T \tag{11}$$

$P_{s,k}^{(tgti)}$: smoothing error covariance matrix of the surrounding vehicle tgti at sampling time k.

$P_{p,k+n}^{(tgti)}$: prediction error covariance matrix at N steps ahead of the surrounding vehicle tgti at sampling time k.

Figure 2:
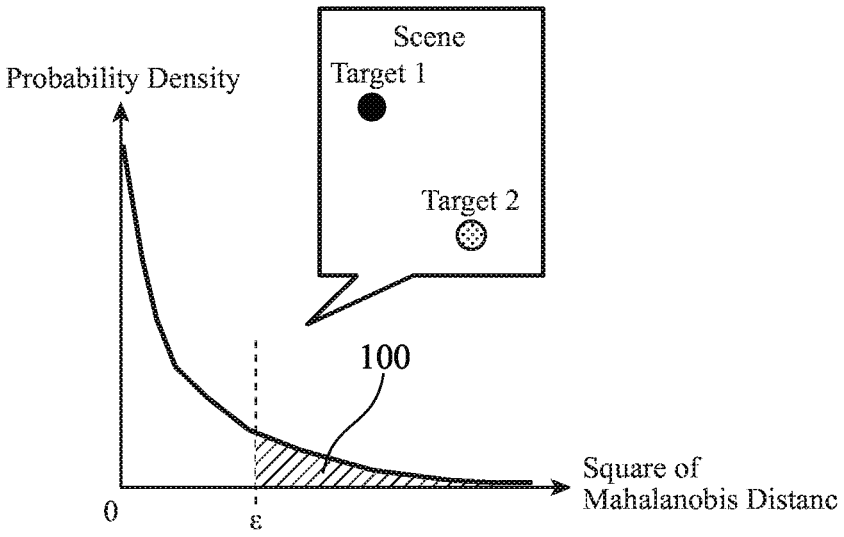
FIG. 2 is a diagram illustrating a collision risk of the route prediction device of the embodiment 1 in accordance with the present invention.

Here, it is known that when two variables, a lateral position x and a lengthwise position y, have a normal distribution, the probability distribution of the square value $\varepsilon_{k+n}$ of the Mahalanobis distance shows a chi-square distribution with 2 degrees of freedom. Using this characteristic, the collision risk estimation unit 5 defines a collision risk as an upper probability of the chi-square distribution as shown in FIG. 2 (shaded area 100 of FIG. 2).

Figure 3:
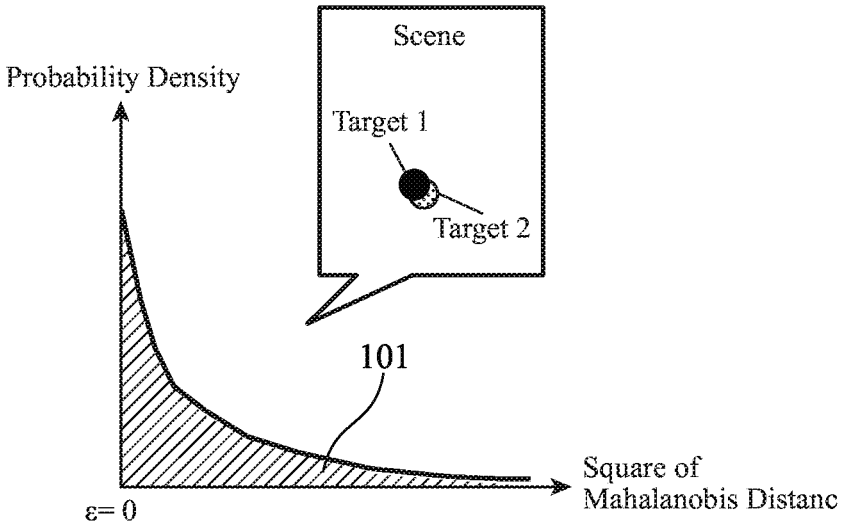
FIG. 3 is a diagram illustrating a case where a collision risk is high in the route prediction device of the embodiment 1 in accordance with the present invention.
Figure 4:
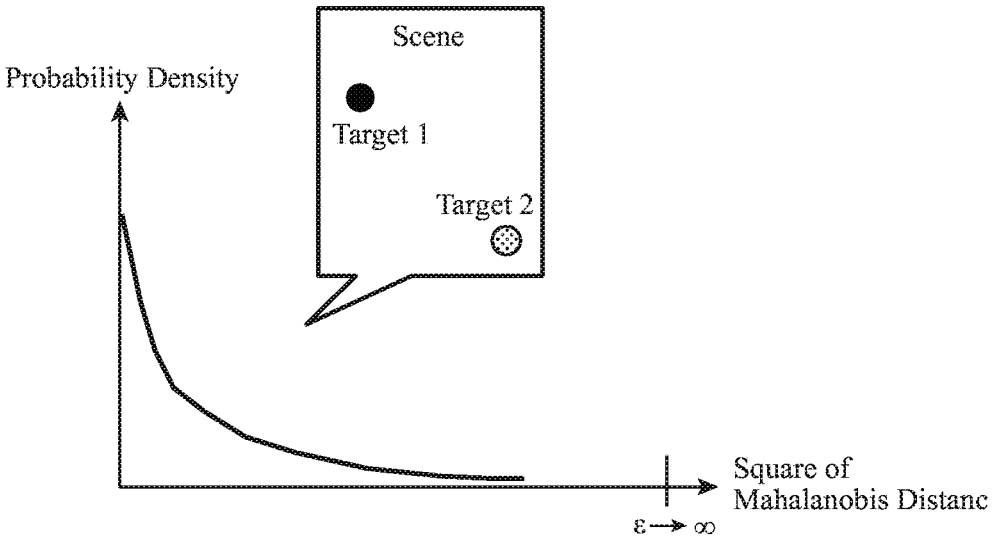
FIG. 4 is a diagram illustrating a case where a collision risk is low in the route prediction device of the embodiment 1 in accordance with the present invention.

To understand the collision risk intuitively, we will describe relationships between the relative positions of the self vehicle (target 2) to the target vehicle (target 1) and the collision risks. For example, in a scene where the target 1 collides with the target 2 as shown in FIG. 3 (the position of the target 1 is the same as that of the target 2), a shaded area 101 of FIG. 3 approaches one. In other words, the collision risk is calculated as 1 (or 100%). In contrast, in a scene where the distance between the target 1 and target 2 is far away infinitely as shown in FIG. 4, the shaded area of FIG. 4 approaches zero. In other words, the collision risk is calculated as 0 (0%). Accordingly, it is seen intuitively that the upper probability of the chi-square distribution is a value corresponding to the collision risk. Furthermore, since a table which shows correspondence between the square value $\varepsilon_{k+n}$ of the Mahalanobis distance and the upper probability of the chi-square distribution is calculable in advance, keeping the table enables the collision risk estimation unit 5 to read out the collision risk corresponding to the square value of the Mahalanobis distance without any calculation.

Although a method of calculating the collision risks from the relative position between the self vehicle and the surrounding vehicle so far, a collision risk calculation method will now be described which uses the absolute positions of the target 1 and target 2. For example, it is conceivable for the driving support system of the vehicle to acquire absolute values such as the GPS positions of the self vehicle and a surrounding vehicle via intervehicle communication. In addition, in a field of air-traffic control, it is conceivable that positions observed by a radar or GPS positions are obtained as to a plurality of aircraft to be used for the air-traffic control. In that case, since the individual target positions include position errors, the collision risk estimation unit 5 calculates evaluation values of the collision risks by the following Expressions (12) and (13), and reads out the collision risks corresponding to the evaluation values.

$$\varepsilon_{k+n} = \Delta\hat{x}_{k+n}^{T}(P_{p,k+n}^{(1)} + P_{p,k+n}^{(2)})^{-1}\ \Delta\hat{x}_{k+n} \tag{12}$$

$$\Delta\hat{x}_{k+n} = [\hat{x}_{p,k+n}^{(1)} - \hat{x}_{p,k+n}^{(2)}\ \ \hat{y}_{p,k+n}^{(1)} - \hat{y}_{p,k+n}^{(2)}]^{T} \tag{13}$$

$P_{s,k}^{(tgti)}$: smoothing error covariance matrix of the target tgti at sampling time k.

$P_{p,k+n}^{(tgti)}$: prediction error covariance matrix at N steps ahead of the target tgti at sampling time k.

Here, to calculate the collision risks from an overlap between the error distributions of the targets, although complicated numerical calculations based on the error distributions are essential, the present invention can calculate the collision risks without the complicated numerical calculations.

In addition, the probability distribution of the square values $\varepsilon_{k+n}$ of the Mahalanobis distances can be approximated by another probability distribution (such as a normal distribution).

The collision deciding unit 6 decides a collision from the collision risk the collision risk estimation unit 5 calculates, and if a collision is expected, it outputs the prediction route correction value to the route prediction unit 4 to correct the prediction route again. Unless the collision is expected, it outputs the prediction route and the collision risk to the collision avoidance route selector 7.

As for the collision decision, the collision deciding unit 6 decides that a collision occurs if the minimum value of the probability variables $\varepsilon_{k+n}$ (n=1, . . . , N) is not greater than the threshold $\varepsilon_{t\ h}$. On the assumption that the threshold $\varepsilon_{t\ h}$ uses a chi-square distribution table with the degree of freedom m, the collision deciding unit 6 can decide whether a collision occurs or not easily by setting the collision threshold $\varepsilon_{t\ h}$ corresponding to the collision risks in advance as described above about the collision risk estimation unit 5.

Figure 5:
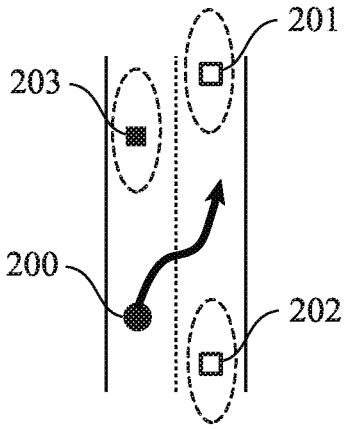
FIG. 5 is a diagram illustrating a collision risk calculation target at a time of steering avoidance in the route prediction device of the embodiment 1 in accordance with the present invention.

In addition, in the case of the steering avoidance as shown in FIG. 5, it is conceivable that other surrounding vehicles are traveling already along the lane into which the self vehicle 200 changes its lane by steering avoidance. Thus, the collision deciding unit 6 calculates collision risks as to the nearest preceding vehicle 201 and the nearest following vehicle 202 in the lane after the change. Furthermore, the collision deciding unit 6 selects the maximum value from the collision risks of the target vehicle 203, nearest preceding vehicle 201 and nearest following vehicle 202, and makes the collision decision. Incidentally, regions enclosed by broken lines in FIG. 5 indicate a prediction error.

Furthermore, the collision deciding unit 6 feeds back the correction value of the prediction route to the route prediction unit 4. Thus, the route prediction unit 4 and collision risk estimation unit 5 calculate the prediction route and collision risk again. It repeats the procedures beyond the threshold $\varepsilon_{t\ h}$.

Figure 6:
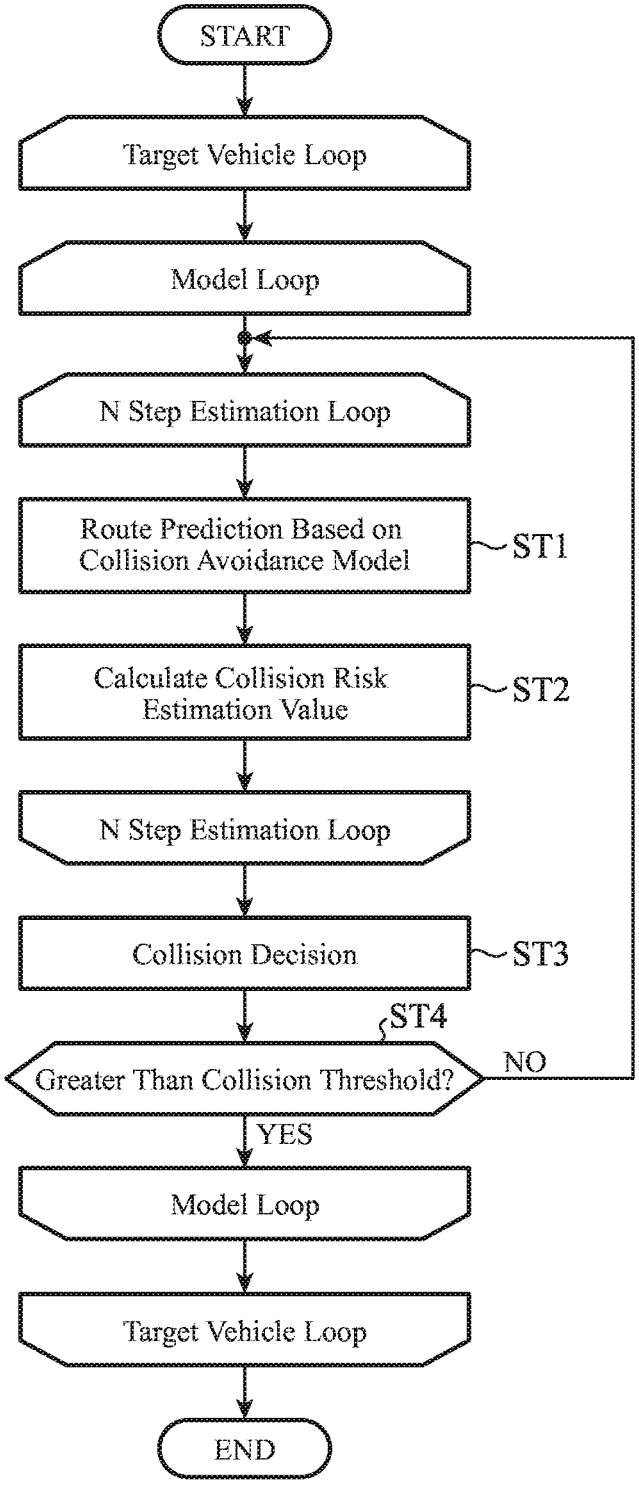
FIG. 6 is a flowchart showing the operation of processing units from a route prediction unit to a collision deciding unit in the route prediction device of the embodiment 1 in accordance with the present invention.

A processing flow from the route prediction unit 4 to the collision deciding unit 6 is shown in FIG. 6. More specifically, for each target vehicle and for all the models, N step route prediction (step ST1) and N step collision risk evaluation (step ST2) are executed, followed by the collision decision (steps ST3 and ST4). In addition, if the decision result is not greater than the collision threshold at step ST4, the model loop is executed until the collision threshold is passed. Incidentally, it is also possible to terminate the calculation of the collision avoidance model when the model loop reaches a predetermined number of times.

The collision avoidance route selector 7 determines a prediction route for avoiding a collision from the prediction routes based on the individual collision avoidance models, which have been calculated from the route prediction unit 4 to the collision deciding unit 6.

As for the N prediction positions based on the individual collision avoidance models, the collision avoidance route selector 7 compares the maximum values of the collision risks, considers the collision avoidance model with the minimum value as the safest avoidance route, and outputs it as the prediction route for avoiding the collision. Incidentally, a configuration is also possible which selects a collision avoidance model with a collision risk not greater than a set point including the minimum value.

In addition, the collision avoidance route selector 7 can compare the sums of the N collision risks given to the N prediction positions, and can select the route with the minimum value. Incidentally, it can also select the collision avoidance models with the collision risks not greater than the set point including the minimum value.

In addition, it may be discarded if the braking amount or steering amount exceeds a prescribed limited value.

In addition, in conformity with the needs of a driver, a route that gives the minimum sum of the braking amounts or a route that gives the minimum sum of the steering avoidance amounts may be selected.

Thus, in the embodiment 1, the collision avoidance models are limited to the models actually assumed, so that a need for calculating countless routes as in the conventional device is eliminated, which makes it possible to reduce the calculation load.

As described above, according to the route prediction device of the embodiment 1, the route prediction device includes a sensor to observe a position of an object of interest and a position of a surrounding object near the object of interest; a tracking processor to carry out tracking processing based on a position of an object of interest and a position of a surrounding object, and to calculate an estimated position and an estimated speed of the object of interest and of the surrounding object; a collision object detector to detect as a target object a surrounding object having a possibility of colliding with the object of interest based on the estimated position and the estimated speed; a route prediction unit to estimate a route of the object of interest with respect to the target object in accordance with collision avoidance models; a collision risk estimator to calculate collision risks between the object of interest and the target object in conformity with the collision avoidance models; a collision deciding unit to decide presence or absence of a collision based on the collision risks, and when it is determined that the collision occurs, to feed back a collision avoidance model correction value to the route prediction unit; and an avoidance route selector to select any of the plurality of collision avoidance models in which the absence of collision is decided by the collision deciding unit, and to select a route of the collision avoidance model as a route for avoiding a collision between the objects, and the route prediction unit carries out a new route prediction using the collision avoidance model correction value. Accordingly, the route prediction device can reduce the computing load at the time of calculating the prediction route with a low collision risk.

In addition, according to the route prediction device of the embodiment 1, it is configured in such a manner that the tracking processing unit calculates the estimation error of the estimated position and the estimation error of the estimated speed; and that the collision risk estimation unit calculates a collision risk from the value obtained by normalizing the estimated position by the estimation error. Accordingly it can calculate the collision risk without complicated numerical calculations.

In addition, according to the route prediction device of the embodiment 1, since it is configured in such a manner that the collision risk estimation unit acquires the collision risk from the table showing correspondence between the value obtained by normalizing the estimated position by the estimation error and the collision risk, it can obtain the collision risk easily without the numerical calculation.

In addition, according to the route prediction device of the embodiment 1, the avoidance route selector is configured in such a manner that as for the time-direction accumulated value of the collision risks of the collision avoidance models, the avoidance route selector selects the collision avoidance model with the accumulated value not greater than the set point. Accordingly, it can obviate the need for computing the countless routes, thereby being able to reduce the computing load.

In addition, according to the route prediction device of the embodiment 1, the avoidance route selector is configured in such a manner that it adopts as the representative value the maximum value in the time direction of the collision risks of the collision avoidance models, and selects the collision avoidance model with the representative value not greater than the set point. Accordingly, it can obviate the need for computing the countless routes, thereby being able to reduce the computing load.

In addition, according to the route prediction device of the embodiment 1, since the collision deciding unit is configured in such a manner as to make the collision decision by comparing the collision risks with the threshold that has been set, it can decide whether the collision can occur or not easily.

Incidentally, it is to be understood that variations of any components of the individual embodiments or removal of any components of the individual embodiments is possible within the scope of the present invention.

INDUSTRIAL APPLICABILITY

As described above, a route prediction device in accordance with the present invention relates to a route prediction device that observes positions of moving bodies such as aircraft, vessels and vehicles with an observational instrument comprised of a sensor like a radar or GPS, and predicts a route for preventing a moving body from colliding with a plurality of its surrounding moving bodies in accordance with the observed values, and that is suitable for applications to a driving support system of a vehicle and air-traffic control.

DESCRIPTION OF REFERENCE SYMBOLS

1 sensor unit; 2 tracking processing unit; 3 collision object detector; 4 route prediction unit; 5 collision risk estimation unit; 6 collision deciding unit; 7 collision avoidance route selector.

What is claimed is:

1. A route prediction device comprising:

a tracking processor that carries out tracking processing based on a position of an object of interest and a position of a surrounding object near the object of interest, and that calculates an estimated position and an estimated speed of the object of interest and of the surrounding object;

a collision object detector that detects as a target object a surrounding object having a possibility of colliding with the object of interest based on the estimated position and the estimated speed;

a route predictor that estimates a route of the object of interest with respect to the target object in accordance with collision avoidance models;

a collision risk estimator that calculates collision risks between the object of interest and the target object in conformity with the collision avoidance models;

a collision decider to decide presence or absence of a collision based on the collision risks, and when it is determined that the collision occurs, that feeds back a collision avoidance model correction value to the route predictor; and an avoidance route selector that selects any of the plurality of collision avoidance models in which the absence of collision is decided by the collision decider, and that selects a route of the collision avoidance model as a route for avoiding a collision between the objects, wherein the route predictor carries out a new route prediction using the collision avoidance model correction value, the tracking processor calculates an estimation error of the estimated position, and the collision risk estimator obtains the collision risk on a basis of a value obtained by normalizing the estimated position with the estimation error.

2. The route prediction device according to claim 1, wherein the collision risk estimator calculates the collision risk from the value obtained by normalizing the estimated position with the estimation error.

3. The route prediction device according to claim 1, wherein the collision risk estimator acquires the collision risk from a table showing correspondence between the value obtained by normalizing the estimated position with the estimation error and the collision risk.

4. The route prediction device according to claim 1, wherein the collision decider makes a collision decision by comparing the collision risks with a threshold that has been set.

5. The route prediction device according to claim 1, further comprising a sensor to observe a position of the object of interest and a position of the surrounding object.

6. A route prediction device comprising:

a tracking processor that carries out tracking processing based on a position of an object of interest and a position of a surrounding object near the object of interest, and that calculates an estimated position and an estimated speed of the object of interest and of the surrounding object;

a collision object detector that detects as a target object a surrounding object having a possibility of colliding with the object of interest based on the estimated position and the estimated speed;

a route predictor that estimates a route of the object of interest with respect to the target object in accordance with collision avoidance models;

a collision risk estimator that calculates collision risks between the object of interest and the target object in conformity with the collision avoidance models;

a collision decider to decide presence or absence of a collision based on the collision risks, and when it is determined that the collision occurs, that feeds back a collision avoidance model correction value to the route predictor; and an avoidance route selector that selects any of the plurality of collision avoidance models in which the absence of collision is decided by the collision decider, and that selects a route of the collision avoidance model as a route for avoiding a collision between the objects, wherein the route predictor carries out a new route prediction using the collision avoidance model correction value, and the avoidance route selector selects the collision avoidance model in accordance with a result obtained by processing the collision risks of the collision avoidance models in a time direction.

7. The route prediction device according to claim 6, wherein the avoidance route selector selects, as for time-direction accumulated values of the collision risks of the collision avoidance models, a collision avoidance model with an accumulated value not greater than a set point.

8. The route prediction device according to claim 6, wherein the avoidance route selector adopts as a representative value a maximum value in a time direction of the collision risks of the collision avoidance models, and selects a collision avoidance model with the representative value not greater than a set point.

9. The route prediction device according to claim 6, wherein the collision decider makes a collision decision by comparing the collision risks with a threshold that has been set.

10. The route prediction device according to claim 6, further comprising a sensor to observe a position of the object of interest and a position of the surrounding object.

* * * * *